United States Patent [19]

Gulliksen et al.

[11] 4,338,655

[45] Jul. 6, 1982

[54] LUMINAIRE APPARATUS INCLUDING EXPANSIBLE REFLECTOR MEANS AND METHOD OF REFLECTING RADIANT ENERGY TO PROVIDE A SPOT TO FLOOD CONFIGURATION

[75] Inventors: John E. Gulliksen, Shrewsbury; William H. Hamilton, Lincoln, both of Mass.

[73] Assignee: Koehler Manufacturing Company, Marlborough, Mass.

[21] Appl. No.: 198,660

[22] Filed: Oct. 20, 1980

[51] Int. Cl.[3] ..... F21V 7/16; F21V 7/02

[52] U.S. Cl. ..... 362/281; 362/282; 362/283; 362/297; 362/307; 362/346; 362/347

[58] Field of Search ..... 362/283, 281, 282, 297, 362/307, 346, 347

[56] References Cited

U.S. PATENT DOCUMENTS

| | | | |
|---|---|---|---|
| 4,164,012 | 8/1979 | Gulliksen | 362/282 |
| 4,187,531 | 5/1980 | Lowell et al. | 362/283 |
| 4,207,607 | 6/1980 | Gulliksen | 362/282 |

*Primary Examiner*—Irwin Gluck

*Attorney, Agent, or Firm*—Hamilton, Brook, Smith and Reynolds

[57] ABSTRACT

A luminaire apparatus includes a housing having a source of radiant energy mounted therein, a rotatable light transmitting member supported at one side of the housing and reflector means. The reflector means consists of a stationary reflector body and expansible reflector means for controlling the configuration of radiation energy projected through the light transmitting member located between the stationary reflector body and the light transmitting member. In one desirable form the stationary reflector body is provided with a specular surface which projects reflected light in a spot configuration while the expansible reflector means is provided with light diffusing surfaces which are operable to progressively modify the spot configuration to provide a flood configuration. In another desirable form the specular and diffusing surfaces may be interchanged so that the stationary reflector body produces a flood configuration and the expansible reflector means is operable to modify the flood configuration to spot configuration.

The expansible reflector means is engageable with the rotatable light transmitting member and comprises a plurality of reflector surfaces which are connected to one another.

24 Claims, 17 Drawing Figures

Fig. 1
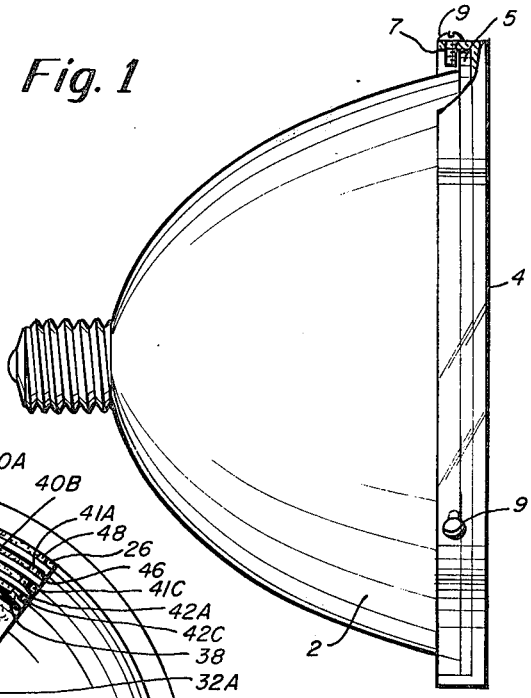
Fig. 2
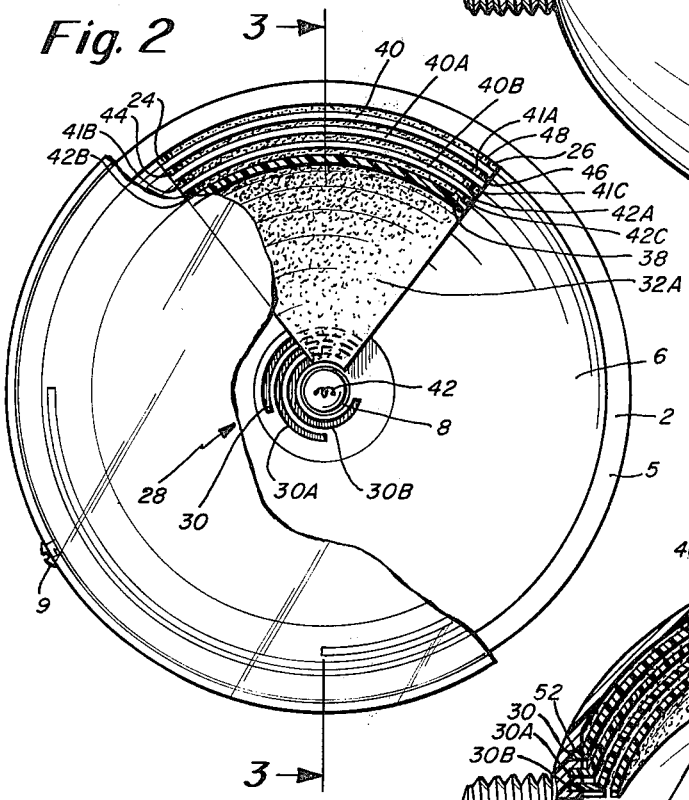
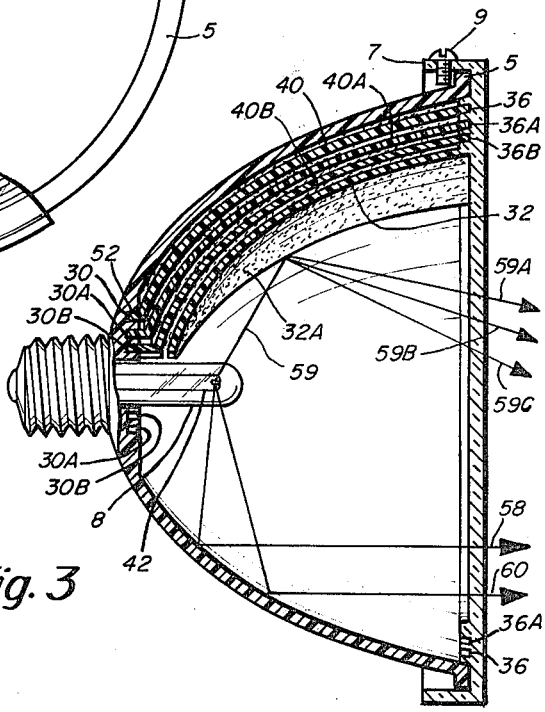
Fig. 3

LUMINAIRE APPARATUS INCLUDING EXPANSIBLE REFLECTOR MEANS AND METHOD OF REFLECTING RADIANT ENERGY TO PROVIDE A SPOT TO FLOOD CONFIGURATION

BACKGROUND OF THE INVENTION

Control of reflected radiant energy to provide either a spot or flood configuration of projected rays of radiation is well known in the art. In Kurlander U.S. Pat. No. 1,991,753 issued in 1935 there is disclosed a Flash Light which includes a movable sleeve having light diffusing surfaces which are operative to change a spot configuration to a flood configuration.

There are also known to the art radiation control means such as iris type devices, collimating lens devices having a radiant energy source movable with respect to a reflector body, as well as dual lens devices and others.

More recently luminaire apparatus for changing emitted radiation from a source of radiant energy from spot to flood configuration has been disclosed in U.S. Pat. No. 4,164,012 issued to Gulliksen and assigned to the assignee of the present application. In this patent there is set forth a source of radiant energy and reflector means occurring as separated reflector sections or parts with which is combined radiation transmitting means which is supported for rotative travel around the reflector parts and which include control zones operative to provide a spot to flood configuration of emitted radiant energy.

It is believed, however, that none of these prior art devices disclose or are concerned with a luminaire apparatus wherein both stationary and movable reflector parts are located around a source of radiant energy in a housing body and means are combined with the movable reflector parts for controlling emitted radiation to produce either a spot or flood configuration of projected radiant energy.

SUMMARY OF THE INVENTION

This invention relates to an improved luminaire and to a method of reflecting radiant energy from a variable number of differing reflecting surfaces to provide for controlling reflected radiation from a spot to flood configuration or from a flood to spot configuration.

It is a chief object of the invention to provide an improved luminaire apparatus by means of which reflected radiation may be selectively controlled with respect to the configuration of light produced.

Another object of the invention is to devise multiple reflector means, uniquely combined, for reflecting radiant energy from both a stationary reflector body and expansible reflector means.

Still another object of the invention is to combine, in a luminaire housing having a rotating light transmitting member, a stationary reflector body and expansible reflector means comprising a plurality of reflector parts which are movable with respect to one another in response to rotative movement of the light transmitting member.

It is still another object of the invention to devise an arrangement of connected reflector parts which are movable around the central axis of a source of radiant energy along guided paths of travel.

The invention apparatus achieves the objectives noted above by combining with a luminaire housing, having a light transmitting member rotatably mounted therearound, both a stationary reflector means and expansible reflector means. The expansible reflector means is operatively connected to the light transmitting member and, in response to rotation of the light transmitting member, is extensible and and controllable about the interior light source along guided paths of travel. As the expansible reflector means is extended, reflection of light from the light source occurs in a configuration progressively different from the configuration of light reflected from the stationary reflector body and thus a desirable range of control is realized.

BRIEF DESCRIPTION OF THE DRAWINGS

FIG. 1 is a side elevational view of the luminaire apparatus of the invention.

FIG. 2 is a front elevation of the structure shown in FIG. 1 and having a light transmitting member partly broken away to more clearly show light reflecting parts of the apparatus.

FIG. 3 is a cross-section taken on the line 3—3 of FIG. 2.

DETAILED DESCRIPTION OF THE INVENTION

Figure 4:
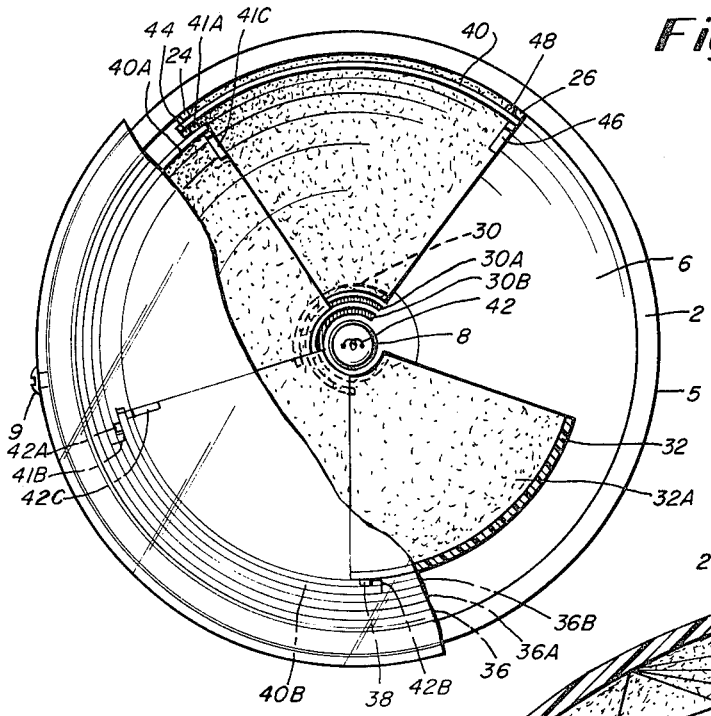
FIG. 4 is another front elevational view similar to FIG. 2, but indicating expansible reflector means in a partially extended position of adjustment.
Figure 5:
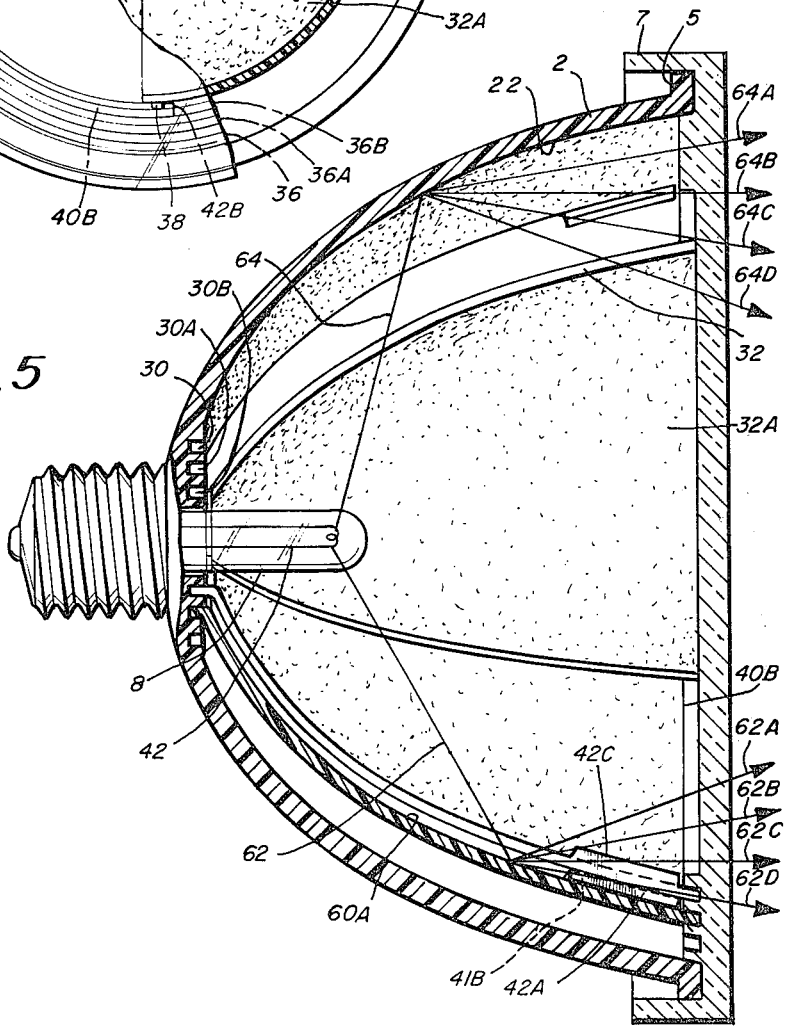
FIG. 5 is a cross-section taken on the line 5—5 of FIG. 6.

The apparatus of the invention in general includes a luminaire housing body, closed at one side by a light transmitting member rotatably mounted thereon, having a light source detachably received therein. Supported in fixed relation around the light source is a stationary reflector body. Located between the stationary reflector body and the light transmitting member is expansible reflector means which are operatively connected to the light transmitting member which, in response to rotation of the light transmitting member, is extensible around the light source along guided paths of travel. As the expansible reflector means is extended light is projected from the luminaire in a configuration progressively changing from that configuration reflected from the stationary reflector body to that configuration reflected from the expansible reflector means, and a desirable range of control is thus realized.

The expansible reflector means may be provided in at least two desirable forms. In one form separately formed reflector parts are arranged in connected relationship with one another and with the rotatable light transmitting member. In another desirable form the reflector means comprises parts occurring in hinged relationship to one another to constitute a unitary body which is operatively connected to the light transmitting member.

Considering first the structure shown in FIGS. 1–10, wherein separately formed expansible reflector parts are illustrated, numeral 2 denotes a luminaire housing body. The housing body 2 is closed at one side by a light transmitting member 4 and has a light source 8 (FIGS. 2 and 3) detachably received therein. Light transmitting member 4 is rotatably mounted on the housing 2 and, in one preferred embodiment, the housing is constructed with an outer annular rim portion 5 while the light transmitting member 4 is formed with a flange portion 7 engageable around the rim portion 5. Fastening means, for example holding screws as 9, are located through the flange portion 7 and project radially inwardly behind the rim portion 5, as suggested in FIG. 1, to detachably and rotatably secure the light transmitting member 4 in a position such that it may be turned at will.

Figure 6:
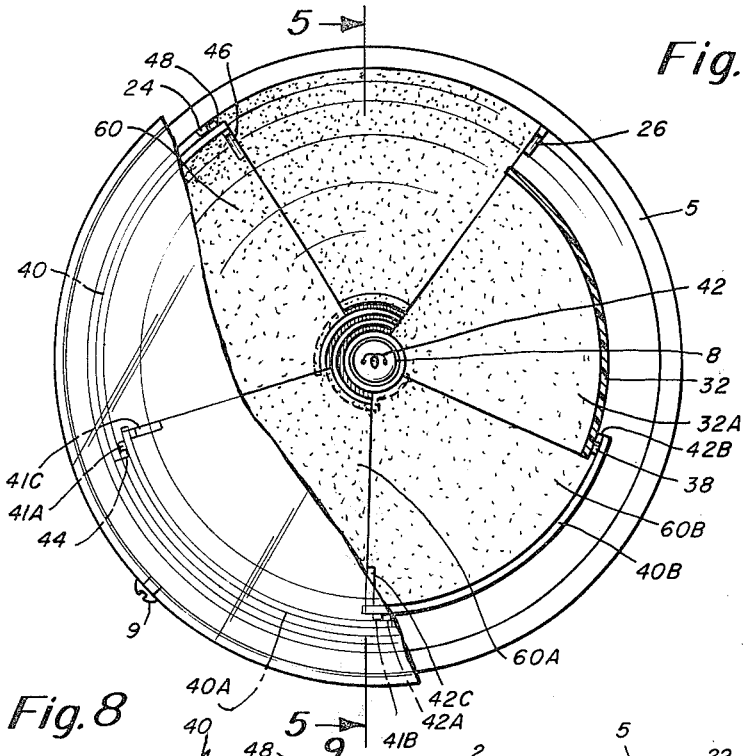
FIG. 6 is a front elevational view of the luminaire with the expansible reflector means in a fully extended position.
Figure 7:
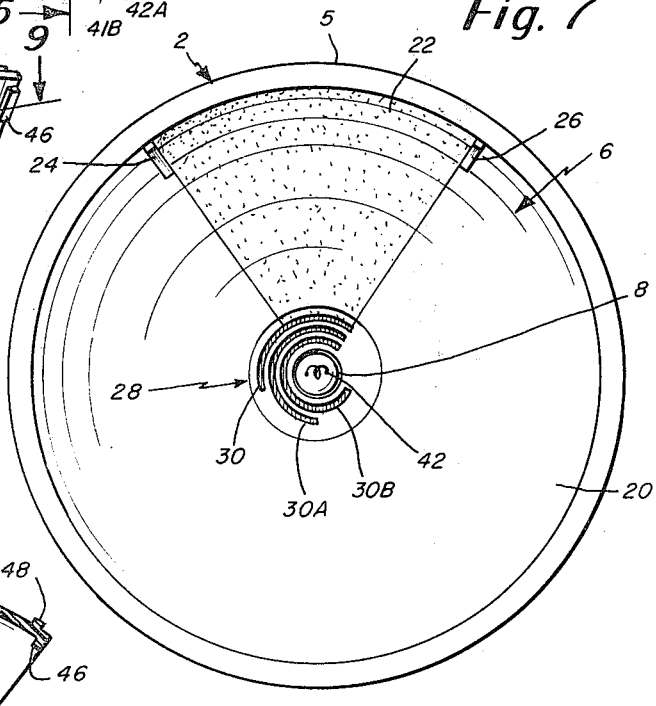
FIG. 7 is a front elevational view of the luminaire apparatus of the invention with the light transmitting member and expansible reflector means removed.

Supported in the housing 2 in fixed relation around the light source 8 is a stationary reflector body 6, characterized by a parabaloidal reflector surface, a portion of which is denoted by the numeral 20 in FIG. 7 and is of specular nature. Another portion, denoted by the numeral 22, presents a matte or dull surface. The reflector body wall is formed integrally with the housing body as shown. Stationary reflector body 6 is also shown in FIGS. 3, 4, 5 and 6 and, as indicated therein, is constructed with inwardly projecting rib portions 24 and 26 occurring at either side of the matte surface 22. The housing body is further formed with channels 30, 30A, 30B located around the light source 8 in radially spaced apart relationship, as is most clearly shown in FIGS. 2, 3, 5 and 7. Examination of FIG. 7 will show that the housing body is also provided with inwardly projecting lug portions 24 and 26.

Figure 10:
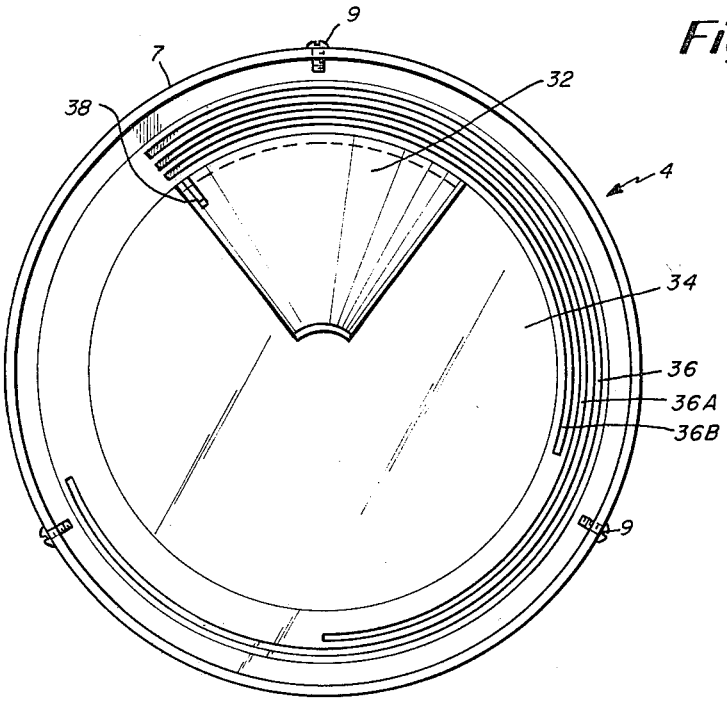
FIG. 10 is an elevational view of the inside of the light transmitting member.

In accordance with the invention, a plurality of separately formed reflector parts are provided and supported for rotative movement in the space between the stationary reflector body and the light transmitting member noted above. These reflector parts are denoted by numerals 40, 40A, 40B and 32 and are illustrated in nested relationship to one another in FIG. 2. These reflector parts are also illustrated in FIGS. 3–6 inclusive and, as shown therein, the separately formed reflector parts 40, 40A, 40B and 32 consist of parabaloidally shaped segments. Parts 40, 40A, 40B extend between channels 30, 30A, 30B and an inner side of the light transmitting member 4. FIG. 10 shows most clearly the inner side of light transmitting member of FIG. 10.

As shown in FIG. 10, the inner surface of the light transmitting member 4 is formed with circumferentially arranged channels 36, 36A, 36B. Inner curved edges of the reflector parts 40, 40A, 40B are engageable in the channels 36, 36A and 36B, respectively. However, the outer curved edge of the part or segment 32 is solidly fixed to the light transmitting member 4 by adhesive or other suitable means to constitute an actuator segment.

It will be seen that, in response to rotative movement of the light transmitting member 4, the movable reflector segments 40, 40A, 40B and 32 may be moved apart or closed together with respect to one another along guided paths of travel. The actuating reflector segment 32 is provided with a reflector surface 32A which is of parabaloidal shape and specular in nature. It will be noted that the actuating reflector segment 32 has located thereon a rearwardly projecting portion 38, as is illustrated in FIG. 10.

The movable reflector parts 40, 40A, 40B present parabaloidally shaped matte reflecting surfaces 60, 60A, 60B, best shown in FIG. 6.

Figure 8:
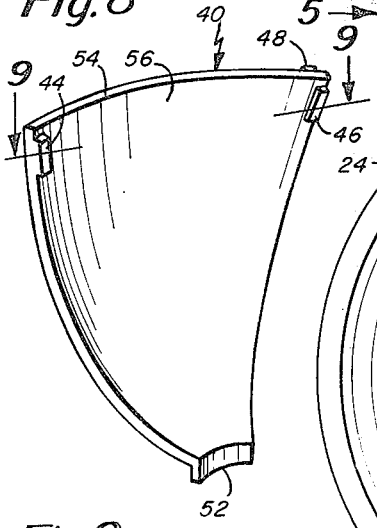
FIG. 8 is a detail view of one typical movable reflector part.
Figure 9:
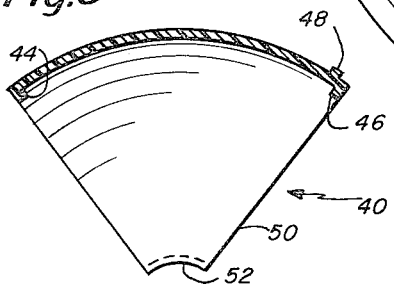
FIG. 9 is a cross-section taken on the line 9—9 of FIG. 8.

In FIGS. 8 and 9 one of the movable reflector parts, namely part 40, is shown removed from the housing body. Also illustrated are two inwardly projecting portions 44 and 46 occurring at opposite edges of the part 40. Further provided on the part 40 is an outwardly projecting portion 48. A curved inner edge of part 40 is provided with an arcuate flange portion 52 engageable in the channel 30 of the tubular member 25.

The projecting portions 44, 46 and 48, which may also be referred to an "lug" portions, do not, as shown in FIG. 8, extend as far as curved edge 54 but are shortened so that outer curved edge 54 may be engageable with the channel 36 in the light transmitting member 4.

Similarly, a movable reflector part 40A at its outer side is formed with a projecting lug 41A engageable with projecting lugs 44 or 46 and at its inner side is formed with projecting lugs 41B and 41C which are in turn engageable with an outwardly projecting lug part 42A formed on the reflector part 40B. Likewise, reflector part 40B is provided with inwardly projecting lug portions 42B and 42C which are engageable with an outwardly projecting lug portion 38 formed on reflector part 32.

In the arrangement of parts noted in FIG. 2 the portion 20 of stationary reflector body 6 is specular in nature and has a focal point located at filament 42 of light source 8. Thus, light projected from this portion of the luminaire with the parts in nested relationship as shown in FIG. 2 will comprise parallel rays to produce a spot configuration of reflected light as suggested in FIG. 3 by the rays 58 and 60. Light rays incident on matte surface 32A, as shown for example at 59, will be diffused as suggested by rays 59A, 59B and 59C, thus providing a partial diffusion of light.

As earlier disclosed, the reflector parts 40, 40A, 40B and 32 comprise expansible reflector means operatively connected to one another and to the light transmitting member 4 and which, in response to rotative movement of the light transmitting member 4, are movable around the interior of the housing along guided paths of travel. As the expansible reflector means is extended with respect to one another reflection of light occurs in a flood configuration progressively different from that configuration disclosed above.

In carrying out this spot to flood configuration of reflected light, the light transmitting member 4 is rotated in a counterclockwise direction as viewed from the front of the housing 2 and the actuating reflector segment 32 is first moved in a short arc of travel sufficient to engage the projecting lug 38 of actuating reflector segment 32 lug portion 42B of movable reflector part 40B. Continued rotation of the light transmitting member will pull movable reflector part 40B along after actuating reflector segment 32 guided in channels 30B and 36B. Further continued rotation of the light transmitting member 4 will progressively cause movable reflector parts 40A and 40 to move around the central axis guided in channels 30A, 36A, 30 and 36, respectively, until projecting lug 48 of movable reflector part 40 comes into contact with projecting lug portion 24 of the stationary reflector body 6.

In the fully extended arrangement of the reflector parts shown in FIG. 6, reflector surfaces 60, 60A and 60B of movable reflector parts 40, 40A and 40B respectively, as well as reflector surface 32A of actuating reflector segment 32, will substantially mask specular surface 20 of the stationary reflector body 6 while leaving a matte surface portion 22 of the stationary reflector body 6 exposed to incident light from the light source 8. In such case light projected from the luminaire body will assume a flood configuration. Examination of FIG. 5 will illustrate the principle: light ray 62 will impinge upon reflector surface 60A of movable reflector part 40A and be broken up into varying rays 62A, 62B, 62C and 62D by the matte surface 60A. Similarly, light ray 64 will impinge upon matte surface portion 22 of stationary reflector body 6 and be dispersed into varying rays 64A, 64B, 64C and 64D.

It will be apparent that any light rays impinging upon either surface 22 of stationary reflector body 6, surface 32A of actuator signal 32, or surfaces 60, 60A, 60B of movable reflector parts 40, 40A, 40B, respectively, will be dispersed by the matte surfaces, thus producing a flood configuration.

The arrangement of reflector parts described above will produce an optimum flood configuration at some sacrifice to an optimum spot configuration (caused by the matte surface 32A). This compromise can be reduced by addition of more movable reflector parts with a corresponding decrease in the arcuate length of each part, including the actuating reflector segment 32.

Should an optimum *uncompromised* spot be desired, even at the expense of an optimum flood, the reflector surface 32A of actuating reflector segment 32 may be made specular. This will produce dispersion of that portion of the available light which impinges upon this surface (32A) at all times, thus compromising the optimum flood. In this configuration it is necessary to have a common focal point for surfaces 32A and 20, located at the filament 42 of light source 8.

It is pointed out that it may be desired to reverse the occurrence of specular and matte surfaces; that is, portion 20 of stationary reflector body 6 may be matte with portion 22 specular; surfaces 60, 60A and 60B of movable reflector parts 40, 40A and 40B, respectively, will then be specular. These surfaces must have a common focal point. The reflector surface 32A of actuating reflector segment 32 may be either matte (comprising spot intensity) or specular (comprising flood intensity). In the second of these alternatives, surface 32A of actuator segment 32 must have a common focal point with surfaces 40, 40A and 40B.

In either of the above alternatives a fully nested position, illustrated in FIG. 2, will produce a flood configuration, while a fully extended or expanded position, as illustrated in FIG. 6, will produce a spot configuration. It will also be apparent that a partial opening or extension of the expansible reflector means will produce a partial spot/flood combination. Therefore, gradual rotation of light transmitting member 4 will produce a gradual transition between spot and flood (or vice versa). It is intended that the invention structure may include more than one set of movable reflector parts combined with more than one actuating reflector segment and that the stationary reflector may be altered to coincide with the selected new configuration. With such an arrangement of reflector parts the "spot" may be made more symmetrical.

When light transmitting member 4 is rotated in a clockwise direction, as viewed from the front, the expansion process is reversed. As an example, when rotation has progressed such that rearwardly projecting lug portion 38 of actuating reflector segment 32 comes into contact with projecting lug portion 42C of movable reflector part 40B further rotation will cause movable reflector part 40B to move in the same counterclockwise direction and so on until rearwardly projecting lug portion 42A comes into contact with the lug portion 41C of movable reflector portion 40A, etc. Rotation may be continued until rearwardly projecting lug portion 48 of movable reflector portion 40 comes into contact with lug portion 26 of housing body 2 (stationary reflector body 6).

In FIGS. 11–16 inclusive another desirable form of the invention referred to above is illustrated in which a plurality of reflector parts are employed in hinged relationship to constitute a unitary expansible reflector body.

Figure 11:
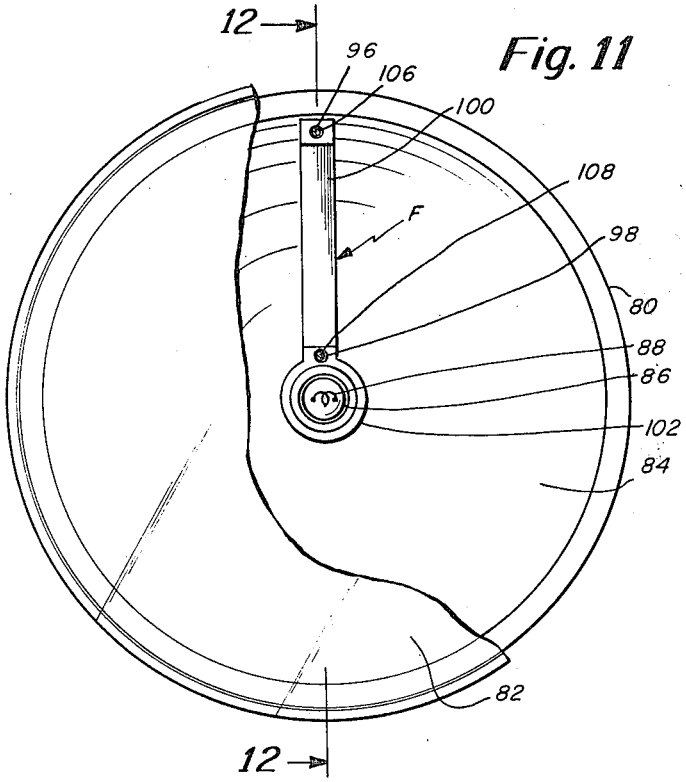
FIG. 11 is a front elevational view of a luminaire having a modified form of expansible reflector means.

As shown in FIG. 11 a luminaire housing body 80 is closed at one side by a light transmitting member 82, partly broken away to indicate a stationary reflector surface 84 having a specular surface for reflecting light. Detachably secured in the housing 80 is a light source 86 which may be an incandescent lamp having a filament 88. The housing body 80 is provided with an annular flange portion 90 which is located around the light source 86, as illustrated in FIG. 12.

Figure 12:
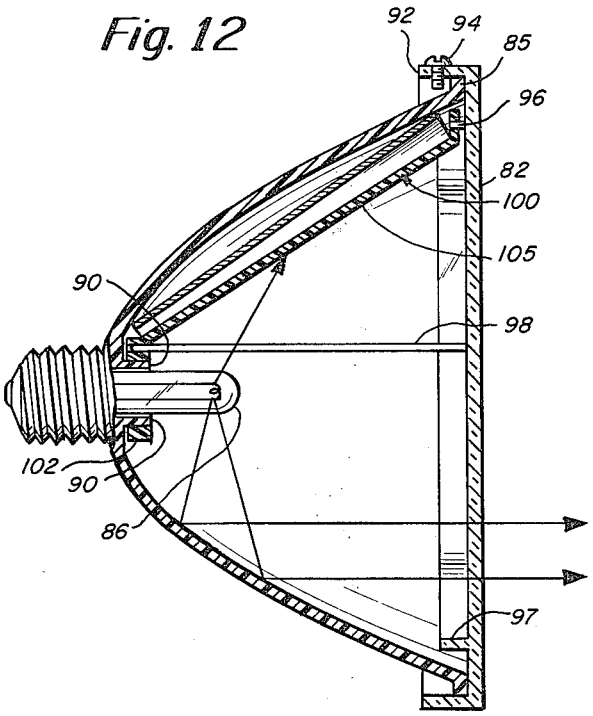
FIG. 12 is a cross-section taken on the line 12—12 of FIG. 11.
Figure 16:
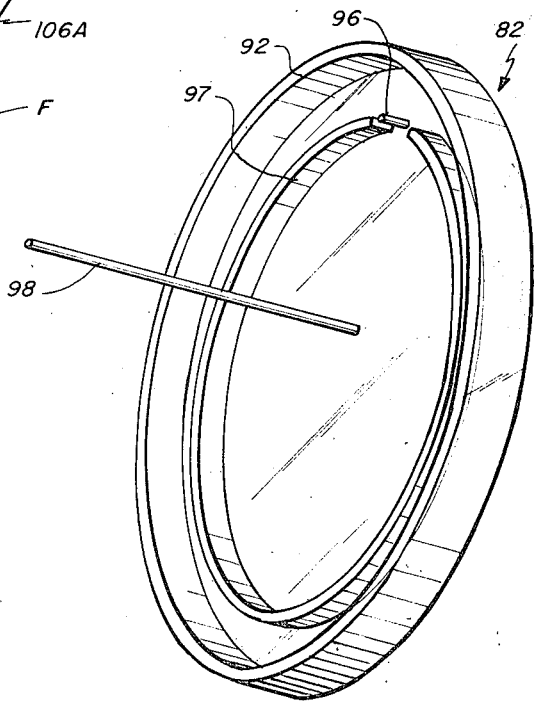
FIG. 16 is the light transmitting member of FIG. 12.
Figure 15A:
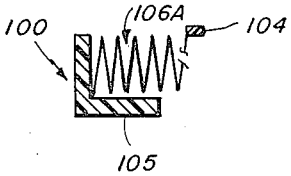
FIG. 15A is a detail cross-sectional view of the expansible reflector means of FIG. 15.

The light transmitting member 82 is formed with a flange portion 92 which, as shown in FIG. 12, is rotatably mounted around a rim portion 85 and secured in place, for example by holding screws as 94, which are radially disposed through the flange portion 92 and extend behind the rim portion 85, as is most clearly shown in FIG. 12. The light transmitting member 82 is illustrated in FIG. 16 removed from the housing and, as shown therein, is provided with inwardly projecting actuator rods 96 and 98, as well as an annular guide part 97.

Figure 15:
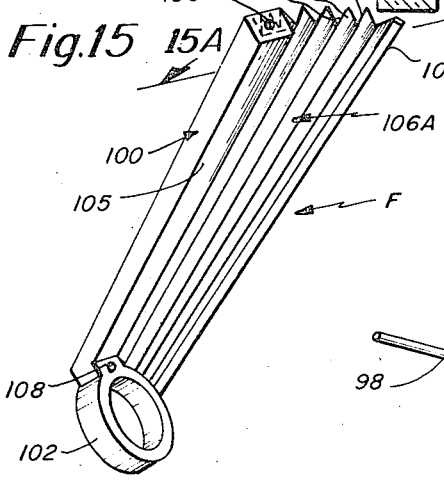
FIG. 15 is a detail perspective view of the expansible reflector means of FIG. 14 removed from the housing.

The luminaire construction described above is further characterized by the inclusion of expansible reflector means generally indicated by the arrow F in FIG. 11 and also shown removed from the housing in FIG. 15. As will be noted from an inspection of FIGS. 11 and 15, the expansible reflector means comprises a radially disposed retaining bar 100 having a guide ring portion 102, a rear support portion 104 and unitary fan-like reflector body 106A.

Unitary reflector body 106A may, for example, comprise a sheet of metalized mylar or other plastic film, folded or pleated to form a fan shaped hinged body. One end of the fan-like body may be attached to retaining bar 100, while the other end may be attached to support portion 104 in the housing.

Retaining bar 100 may be provided with holes 106, 108 at opposite ends thereof, said holes being engageable with rods 96, 98, respectively, of the light transmitting member 82.

Support portion 104 is fixed to the housing body 80 (or to stationary reflector body 84), for example by a suitable adhesive. Retaining bar 100 is provided with a non-reflecting surface 105.

In the fully closed position illustrated in FIG. 11, light emanating from the filament 88 will impinge upon specular parabaloidal surface 84, and is projected in substantially parallel rays to provide a "spot" configuration.

Figure 13:
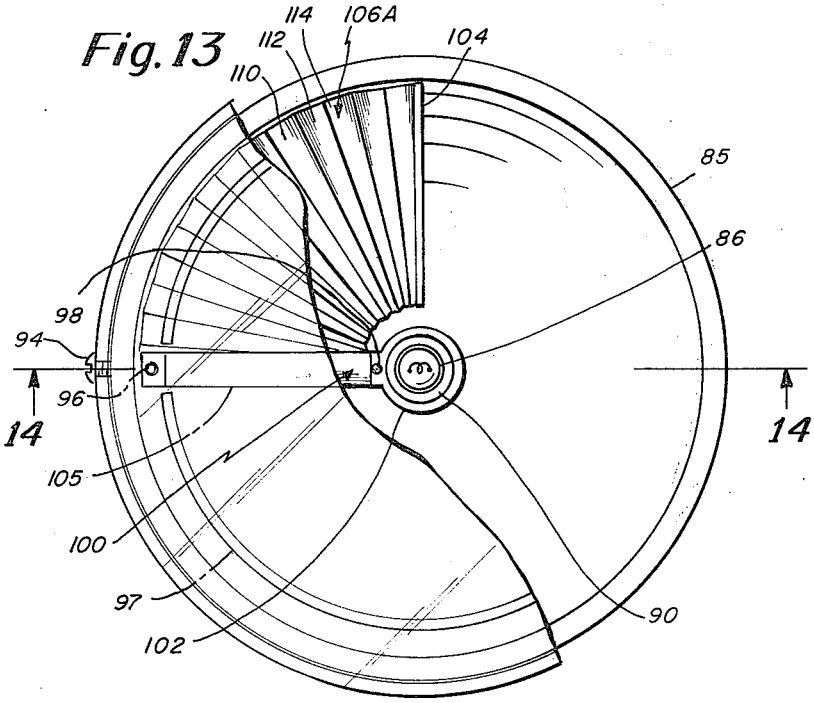
FIG. 13 is a front elevational view showing the apparatus of FIGS. 11 and 12 with the expansible reflector means partially extended.
Figure 14:
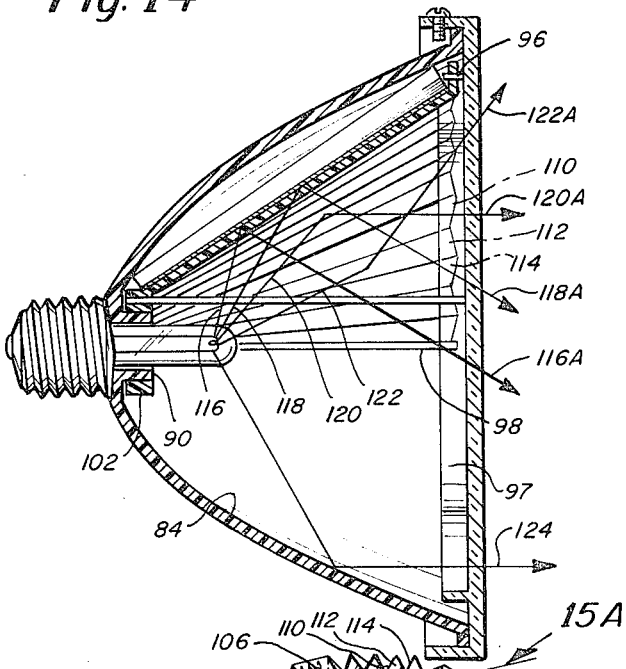
FIG. 14 is a cross-section taken on the line 14—14 of FIG. 13 and illustrates diagrammatically paths of travel of reflected radiation emitted from the luminaire body.

Rotation of light transmitting member 82 will drag or pull retaining bar portion 100 after rods 96 and 98, thus causing expansion or opening of the fan-like unitary reflector body 106A, which will then present a plurality of hinged reflector surfaces as 110, 112, 114 etc. (FIG. 13). These reflector surfaces are planar in configuration and lie in a skew relationship to incident light rays as 116, 118, 120, 122 (FIG. 14). Light will be reflected from these surfaces at varying angles as suggested by rays 116A, 118A, 120A, 122A.

In the partially extended position illustrated in FIG. 14, some of the light will impinge upon that portion of surface 84 which is not masked, and will thus continue to be projected in parallel relationship to the central axis of the luminaire body as suggested by numeral 124.

It will be evident that full expansion of the unitary reflector means 106A will cause the specular reflective surface 84 to be "masked" by the expansible reflector body 106A, thus causing all reflected light to be projected at skew angles to the central axis providing a flood configuration. Degree of flooding may be controlled by the degree of expansion of the unitary reflector body 106A.

We claim:

1. In a method of reflecting radiant energy in which a light source is received in a housing body and radiant energy from the light source is reflected from a stationary reflector surface through a light transmitting member on the housing to provide a desired configuration of the said reflected radiant energy the steps which include interposing expansible reflector means between the stationary reflector surface and the light transmitting member, and rotating the light transmitting member to progressively extend the expansible reflector means around the light source thereby changing the angles of reflection of a portion of the reflected radiant energy thus producing a different configuration of emitted radiation.

2. In a method of reflecting radiant energy in which a light source is received in a housing body and radiant energy from the light source is reflected from stationary reflector means in the luminaire body through a light transmitting member to provide a projected configuration of light rays which is characteristic of the stationary reflector means, the steps which include interposing reflector means between the stationary reflector means and the light transmitting member, and then rotating the light transmitting member to progressively extend the expansible reflector means around the light source thereby to change the angle of reflection of a portion of the reflected radiant energy, thus producing a different configuration, which is characteristic of the expansible reflector means.

3. The invention of claim 2 in which the stationary reflector means is of specular nature thereby to project reflected rays parallel to the central axis of the housing, thus producing a spot configuration, and the expansible reflector means is characterized by matte surfaces which project reflected rays along different paths of travel to produce a flood configuration.

4. The invention of claim 2 in which the stationary reflector means is formed with a matte surface and the expansible reflector means is formed with specular surfaces.

5. The invention of claim 2 in which some light rays are reflected from the stationary reflector means in a configuration which is characteristic of the stationary reflector means, and other light rays emitted by the light source are intercepted and redirected by the expansible reflector means in a partially extended position.

6. The invention of claim 2 in which substantially all of the light rays which are emitted from the light source are intercepted and redirected by the expansible reflector means in a fully extended position.

7. The invention of claim 2 in which component parts of the expansible reflector means are extended along guided paths of travel.

8. Luminaire apparatus which includes a housing having a source of radiant energy mounted therein, a rotatable light transmitting member mounted at one side of the housing through which radiant energy may be emitted, reflector means including a stationary reflector body located around the source of radiant energy and a plurality of expansible reflector parts interposed between the stationary reflector body and the light transmitting member, and the said expansible light reflecting parts being movable in response to rotative travel of the light transmitting member.

9. The invention of claim 8 in which the stationary reflector body presents a reflecting surface of specular character and the expansible reflector parts are characterized by light diffusing surfaces.

10. The invention of claim 8 in which the stationary reflector body presents a matte reflecting surface and the expansible reflector parts have specular surfaces.

11. The invention of claim 8 in which the expansible reflector parts occur in separated relationship to one another.

12. The invention of claim 8 in which the expansible reflector parts occur in hinged relationship to one another.

13. Luminaire apparatus comprising a housing having a source of radiant energy mounted therein, a rotatable light transmitting member supported at one side of the housing through which radiant energy may be emitted, reflector means including a stationary reflector body and expansible reflector means, said stationary reflector body presenting a reflecting surface of specular nature for producing a spot configuration of reflected radiation, said expansible reflector means being characterized by a plurality of light diffusing surfaces for producing a flood configuration of reflected radiant energy, said expansible reflector means further including a plurality of reflector parts connected to the said rotatable light transmitting member and to one another whereby rotation of the light transmitting member is operative to progressively extend the reflector parts and present sectors of light diffusing surfaces of gradually increasing magnitude for producing a flood configuration.

14. Luminaire apparatus which includes a housing having a source of radiant energy mounted therein, a rotatable light transmitting member rotatably supported at one side of the housing through which radiant energy may be emitted, reflector means including a stationary reflector body located around the source of radiant energy and expansible reflector means interposed between the stationary reflector body and the light transmitting member and said expansible reflector means being movable in response to rotative travel of the light transmitting member, said stationary reflector body presenting a reflecting surface of specular character and the expansible reflector means being characterized by a plurality of radiation reflecting parts having light diffusing surfaces, said light transmitting member being formed at its inner side with circular grooves occurring in concentrically spaced apart relation and said expansible light reflecting means consisting of a plurality of arcuate segments having circular edge portions which are engageable with respective grooves in the said radiation transmitting member.

15. The invention of claim 8 in which the stationary reflector body is constructed with a reflector surface of a parabaloidal shape and the arcuate segments are of a similarly curved shape and are arranged in concentrically spaced apart relationship to the said parabaloidal reflector surface.

16. The invention of claim 14 in which the innermost arcuate segment in the said concentrically spaced apart arrangement of segments is solidly fixed to the radiation transmitting member and includes lug means for engaging with a radially adjacent segment.

17. The invention of claim 14 in which the arcuate segments are formed with radially projecting lug portions successively engageable with one another in response to rotation of the light transmitting member to locate all of the segments in extended relationship to one another.

18. Luminaire apparatus which includes a housing having a source of radiant energy mounted therein, a rotatable light transmitting member mounted at one side of the housing through which radiant energy may be emitted, reflector parts including a stationary reflector body located around the source of radiant energy and expansible reflector means interposed between the stationary reflector body and the light transmitting member, said expansible reflector parts being movable in response to rotative travel of the light transmitting member, the stationary reflector body presenting a reflecting surface of specular character and the expansible reflector parts being characterized by light diffusing surfaces, said expansible reflecting parts occurring in connected relationship to one another.

19. The invention of claim 18 in which the reflecting parts are connected together by means of hinge portions.

20. The invention of claim 19 in which one of the connected reflecting parts is attached to an expander arm and collar member rotatably mounted around the source of radiant energy and engaged with the light transmitting member.

21. The invention of claim 1 in which the radiation transmitting member is formed with a connecting rod which is engaged in the said collar member and a second rod engaged in an outer end of the expander arm whereby rotative movement of the radiation transmitting member operates to fan out the reflector parts into a fully extended position.

22. The invention of claim 18 in which the expansible reflector parts comprise a fan shaped body having light diffusing surfaces which are connected to one another by linearly extending hinge portions, one of said expansible reflector parts having secured thereto a retaining bar opposite ends of which are anchored in the housing, a reflector part at an opposite side of the fan shaped body being secured to an actuator bar which is engaged with the light transmitting member.

23. The invention of claim 18 in which the fan shaped body has supported at one end a collar element for guiding inner ends of the expansible parts around the light source.

24. Luminaire apparatus which includes a housing having a source of radiant energy mounted therein, a rotatable light transmitting member mounted at one side of the housing through which radiant energy may be emitted, reflector parts including a stationary reflector body located around the source of radiant energy and expansible reflector means interposed between the stationary reflector body and the light transmitting member, said expansible reflector means extensible and contractible in response to rotative travel of the light transmitting member, the stationary reflector body presenting a reflecting surface of specular character and the expansible means presenting a plurality of reflector parts comprising a fan shaped body having light diffusing surfaces which are connected to one another by linearly extending hinge portions, one of said reflector parts having secured thereto a retaining bar opposite ends of which are anchored to the housing a reflector part at an opposite side of the fan shaped body being secured to an actuator bar which is engaged with the light transmitting member, said actuator bar having supported at one end thereof a collar element for guiding inner ends of the expansible reflector parts around the said light source.

* * * * *